US005816951A

United States Patent [19]

Hudock

[11] Patent Number: 5,816,951

[45] Date of Patent: Oct. 6, 1998

[54] SPORT TRAINING DEVICE HAVING A FLUID-MOTIVE OPERATING SYSTEM

[76] Inventor: John T. Hudock, 53 Joy Dr., North East, Md. 21901

[21] Appl. No.: 753,298

[22] Filed: Nov. 22, 1996

[51] Int. Cl.[6] ..... A63B 09/00

[52] U.S. Cl. ..... 473/447; 446/199; 473/446

[58] Field of Search ..... 473/447, 448, 473/442–446; 434/248; 446/198, 199

[56] References Cited

U.S. PATENT DOCUMENTS

| | | | |
|---|---|---|---|
| 3,552,749 | 1/1971 | Piggotte . | |
| 3,675,921 | 7/1972 | Meyers, Sr. . | |
| 4,565,527 | 1/1986 | Burchett . | |
| 4,609,195 | 9/1986 | Ham | 446/198 |
| 4,989,862 | 2/1991 | Curtis . | |
| 5,052,683 | 10/1991 | Wang et al. | 446/199 |
| 5,338,044 | 8/1994 | Mazursky et al. | 446/199 |
| 5,474,485 | 12/1995 | Smrt | 446/119 |
| 5,485,993 | 1/1996 | Lipsett | 473/448 |
| 5,527,185 | 6/1996 | Davis | 473/447 |

FOREIGN PATENT DOCUMENTS

| | | | |
|---|---|---|---|
| 1509096 | 12/1987 | U.S.S.R. . | |
| 219565 | 7/1924 | United Kingdom | 446/198 |

*Primary Examiner*—Mark S. Graham
*Attorney, Agent, or Firm*—Birch, Stewart, Kolasch, & Birch, LLP

[57] ABSTRACT

A sports training device, which is a simulated human figure having at least one movable limb; a fluid-containing actuating system connected to the movable limb; and a trigger device connected to the fluid-containing actuating system, for activating the fluid-containing actuating system. The training device provides a distractive movement to acclimate the sports player to distractions.

17 Claims, 5 Drawing Sheets

SPORT TRAINING DEVICE HAVING A FLUID-MOTIVE OPERATING SYSTEM

FIELD OF THE INVENTION

The present invention is directed to a training device for sport players which provides a distractive movement, so as to acclimate the sport player to such distractions.

BACKGROUND OF THE INVENTION

Sports contests have recently gained increased popularity, for both entertainment and production of revenue. This increased popularity of sports has resulted in continued improvements in training techniques and devices for the sports participants, especially in a formalized setting, such as a team sponsored practice. For instance, large institutions may provide devices such as pitching machines for baseball players to practice batting.

However, the individual sport participant has been provided very little in the way of practice devices, which can be used with little or no help from other persons. Accordingly, individual practice sessions cannot provide adequate preparation for "real game" situations, when no opposing player is available to practice against.

For example, in basketball a player may practice long hours shooting at a stationary basket, and attain relatively good skills. But in a game situation, the same accomplished player is required to shoot a basket in an environment quite different from the individual practice session; an environment full of distractions, such as when an opposing player raises a hand in front of the shooter. Even a relatively accomplished player must become acclimated to such a distraction, in order to perform up to his or her potential in a game situation.

Heretofore, devices which have been designed to provide a suitable distraction to an individual practicing a sport have involved complex and expensive articulating systems, which limit their practicality, especially for an individual receiving no financial support from an institution. For example, U.S. Pat. No. 3,675,921 discloses a basketball training device having a complex system of motors and levers to effect movement of the device. Such a system is invariably heavy and expensive and therefore unsuitable for an individual, such as a child, to use at home. U.S. Pat. No. 4,989,862 discloses a basketball game practice device which is a figure formed of a synthetic foam. The device can be adjusted to various heights through a telescoping system, and the arms thereof may be manually rotated. However, the device of U.S. Pat. No. 4,989,862 is essentially stationary and does not provide for effecting a distracting movement.

It would be desirable to devise an inexpensive, mechanically simple and lightweight device for sport training which provides a distracting movement upon activation, so as to help an individual player acclimate to distractions, and therefore improve his or her real game performances.

SUMMARY OF THE INVENTION

An object of the present invention is to provide a sports training device, capable of use by an individual without outside assistance, which training device simulates a distractive movement by a sports opponent, so as to acclimate the individual to such distractive movements during a sports performance.

Another object of the present invention is to provide a sports training device which is relatively inexpensive, mechanically simple and lightweight, so as to provide a training device which is readily affordable and useable by an individual sports player.

In one embodiment, the present invention is directed to a sports training device, comprising a simulated human figure having at least one movable limb, a fluid-containing actuating system operatively connected to the movable limb, and a trigger device connected to the fluid-containing actuating system, for pressurizing the fluid-containing actuating system.

In a particular embodiment, the sports training device is a basketball training device, comprising (i) a simulated human figure having at least one movable arm; (ii) a fluid-containing actuating system comprising a reservoir to store the fluid, tubing having proximal and distal ends, connected to the reservoir at the proximal end and connected to the movable arm at the distal end, to contain and transmit the fluid to the movable arm, and a pressure conversion device connected to the distal end of the tubing, to convert fluid pressure to linear or rotational motion of the movable arm, and operatively connected to the movable arm; and (iii) a trigger device connected to the fluid-containing actuating system, for activating the fluid-containing actuating system.

BRIEF DESCRIPTION OF THE DRAWINGS

The above and other objects, features and advantages of the present invention will be better understood from the following detailed descriptions taken in conjunction with the accompanying drawings, all of which are give by way of illustration only, and are not limitative of the present invention.

DETAILED DESCRIPTION OF THE INVENTION

The following detailed description of the invention is provided to aid those skilled in the art in practicing the present invention. Even so, the following detailed description of the invention should not be construed to unduly limit the present invention, as modifications and variations in the embodiments herein discussed may be made by those of ordinary skill in the art without departing from the spirit or scope of the present inventive discovery.

Figure 1:
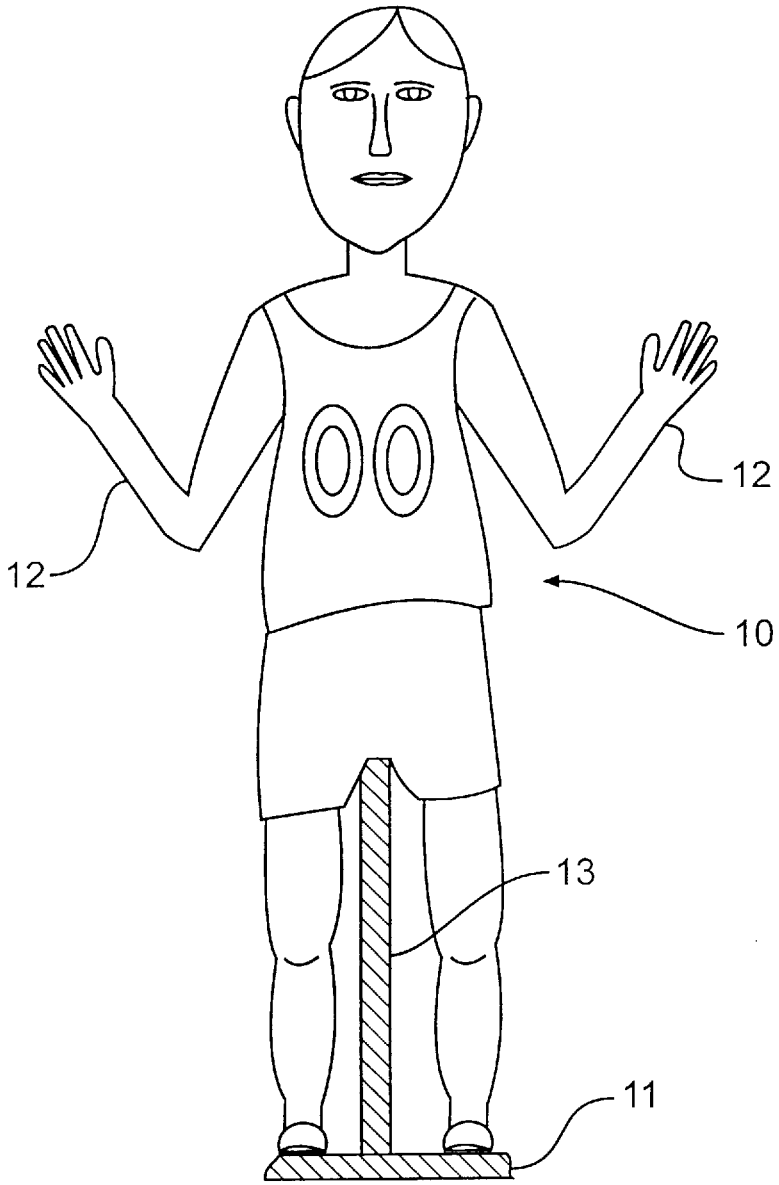
FIG. 1 is a front view of a preferred embodiment of the sports training device of the present invention.

FIG. 1 illustrates a particular embodiment of the sports training device of the present invention, which is a basketball training device having a simulated human FIG. 10 with movable arms 12. The figure is supported by a stand 13 and has a trigger device 11 in the form of a flexible mat disposed on the ground or floor in front of the figure.

The simulated human figure is preferably made of an inexpensive light-weight, durable material, such as cardboard, or a foamed polymer such as foamed polystyrene or polyurethane. The simulated human figure may be painted or otherwise decorated to resemble a known sports celebrity.

The sports training device includes a fluid-containing actuating system, i.e. a hydraulic or pneumatic system, which has a reservoir to store a motive fluid, tubing having proximal and distal ends, connected to the reservoir at the proximal end and connected to the movable limb at the distal end, to contain and transmit the fluid to the movable limb and pressure conversion means connected to the distal end of the tubing and to the movable limb, to convert fluid pressure to linear or rotational motion of the movable limb.

Figure 2:
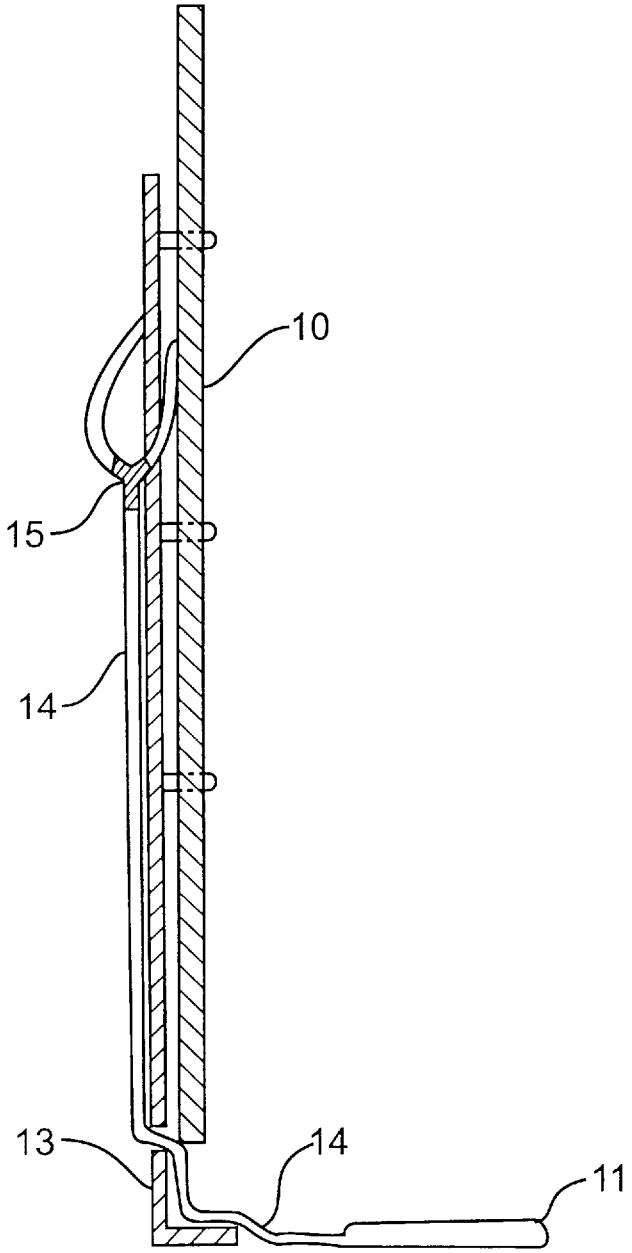
FIG. 2 is a schematic side view of the sports training device of FIG. 1.

FIG. 2 is a schematic side view of the FIG. 1 device, which shows a portion of the fluid-actuating system, including tubing 14 connected to the trigger device 11, running into the bottom of the sports training device and upward to an optional splitter device 15. In the embodiment illustrated in FIGS. 1–4, the fluid reservoir is the flexible mat 11, which is a substantially flat vessel, and is pressurized by an individual stepping or jumping onto the mat, thus forcing the fluid through the tubing of the fluid-actuating system, so as to ultimately move the arm. The splitter device 15 may be a "Y" or "T" shaped tubing connector and acts to divide the fluid flow into the arms, when it is desired to activate both arms.

In this embodiment, the fluid reservoir also acts as the trigger device, and may take the form of a flat elastomeric vessel, such as a rubber or plastic bladder. When depressed, a gas or liquid within the bladder is pressurized and flows through the tubing to actuate movement of the arms.

It is contemplated that an individual utilizing the sports training device of the present invention may store the inventive device disassembled, in a relatively small space, for instance in a closet or a garage, and set-up the device for use relatively quickly. In the event a gas, such as air, is used as the motive fluid, one need merely connect the various components of the invention together, so as to communicate the trigger/bladder with the tubing of the fluid-actuating system. When a liquid, such as water or a gel, is utilized as the motive fluid, the individual using the training device can use a garden hose to fill the fluid-actuating system with the liquid. It may be necessary to provide one or more check valves and/or bleed valves in the fluid-actuating system so as to eliminate air bubbles in the fluid-actuating system, and to maintain the liquid at the proper level in the system, or to otherwise control pressurization and depressurization of the fluid-activating system.

Figure 3A:
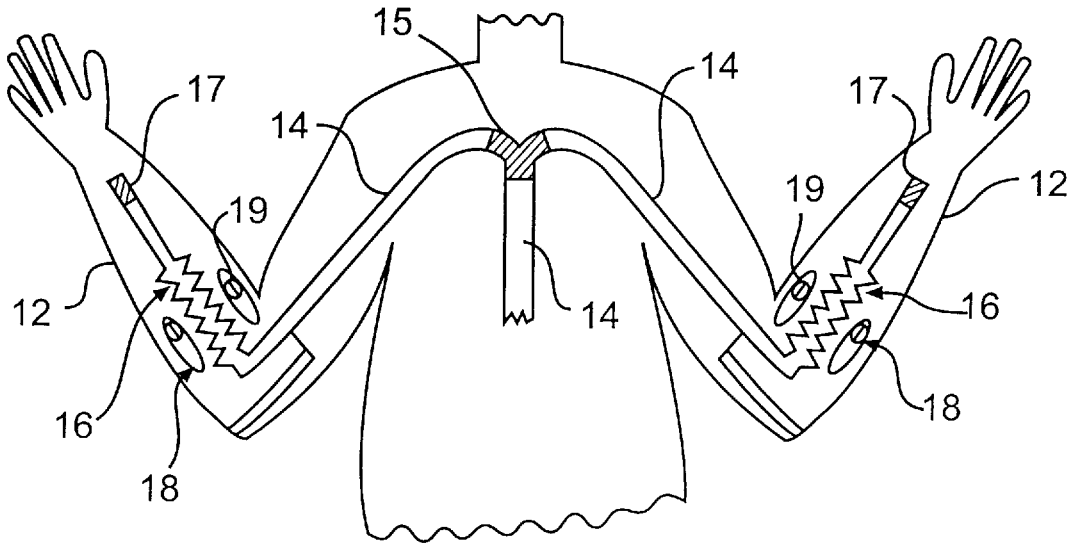
FIGS. 3*a* and 3*b* are rear views of a first embodiment of the present invention, illustrating slidable arms.
Figure 3B:
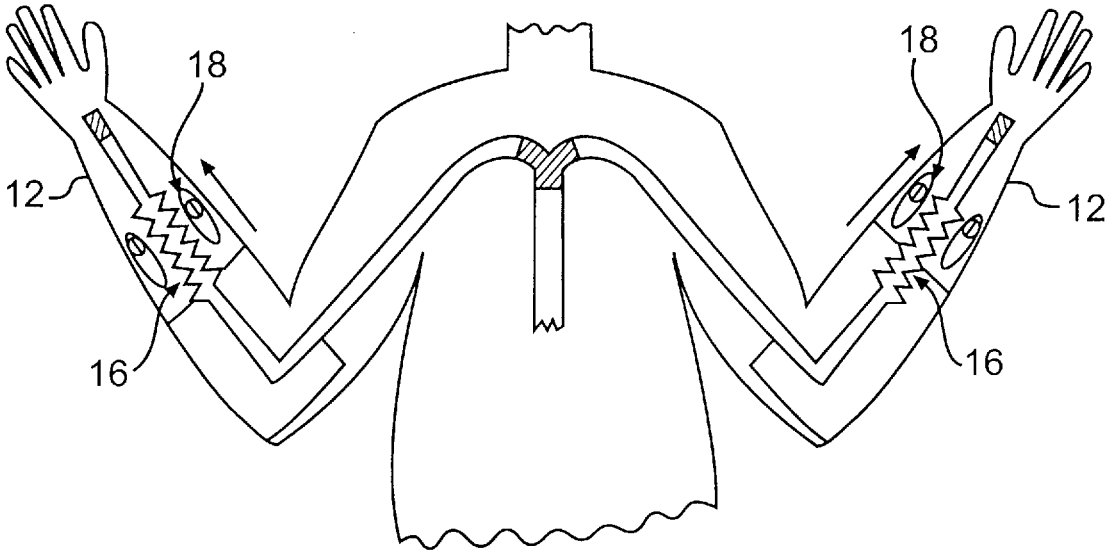

FIG. 3*a* is a rear view of the invention, illustrating one embodiment of the pressure conversion means, which in this case is a bellows 16, the lower portion of which is affixed to the simulated human figure and the upper portion of which is affixed to the movable arm. Upon pressurization of the trigger device, fluid is forced through the tubing and up into the bellows 16. Fluid pressure is maintained in the bellows by a bleed or check valve 17 disposed at the distal end of the bellows and affixed to the movable part of the limb, and the bellows expands to relieve the pressure, FIG. 3*b*. Upon expansion of the bellows 16, the movable arm(s) 12, which is slidably attached to the simulated human figure, for instance through slotted holes 18 secured with bolts 19, extends to provide the distractive movement which is the object of the training device.

Figure 4A:
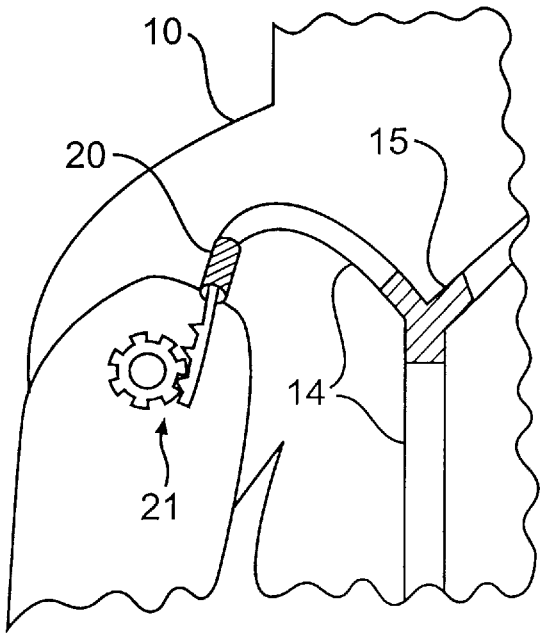
FIGS. 4*a* and 4*b* are rear views of a second embodiment of the present invention, illustrating pivotable arms.
Figure 4B:
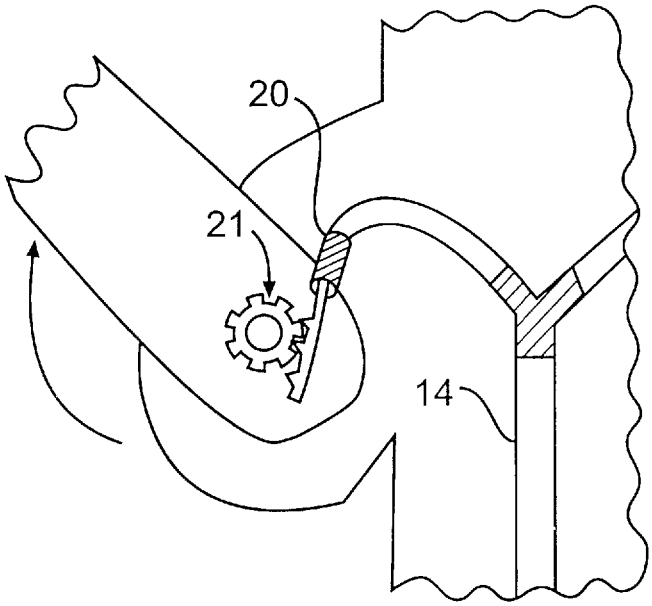

FIGS. 4*a* and 4*b* illustrate an alternative embodiment of the pressure conversion means, which is a rack and pinion gear system 21, wherein the rack gear is connected to a piston 20, which is in turn connected to the distal end of the tubing 14. In this embodiment, upon pressurization of the fluid within the system, the piston 20 is forced away from the system interior, thus moving the rack gear distally and rotating the pinion gear which is affixed to the movable arm at the pivot point, to obtain pivotal movement of the figure arm(s).

However, those skilled in the art will recognize that any device which can accomplish conversion of a fluid pressure to linear or rotational motion, such as a piston/crank arrangement, may be utilized as the pressure conversion means with the scope of the present invention.

Figure 5:
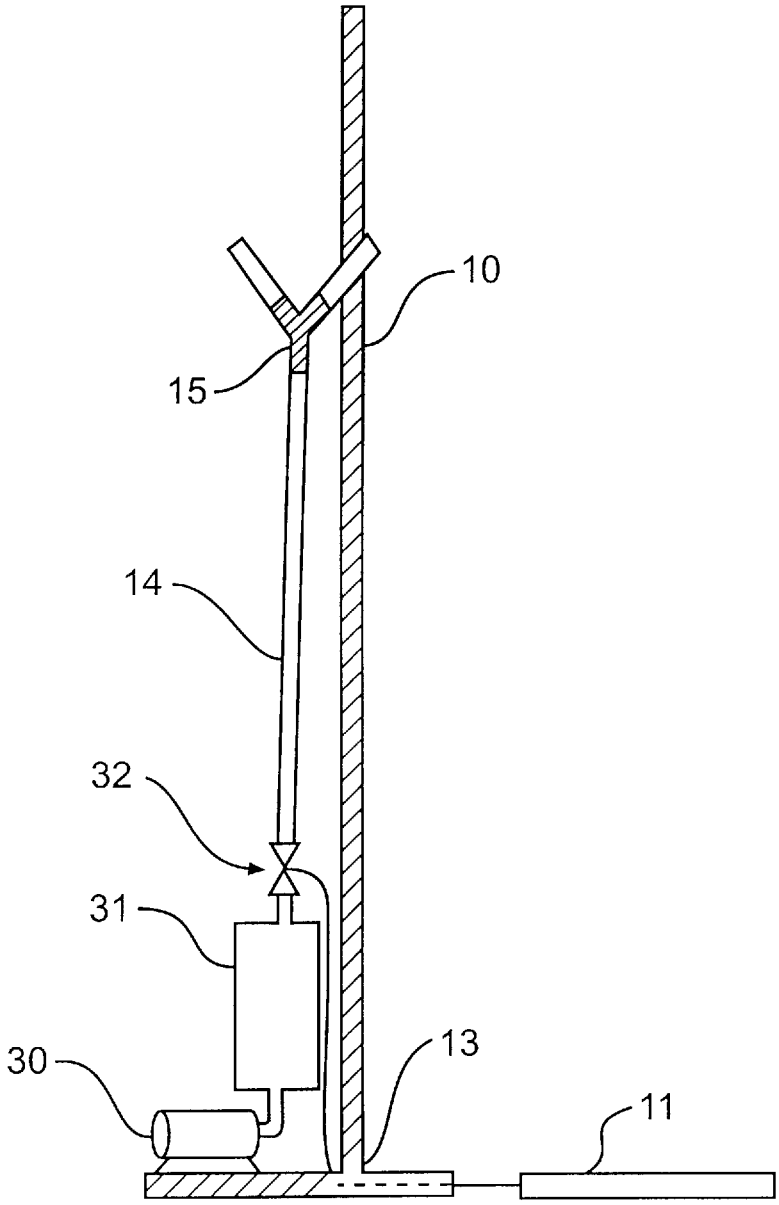
FIG. 5 is a side view of an alternative embodiment of the present invention, which utilizes a pressurized gas as the fluid component.

FIG. 5 is a side view of an alternative embodiment of the present invention, wherein a pressurized gas, such as air, is used as the motive fluid. Since gas is highly compressible, a gas-filled system is much less efficient than a liquid-filled system in transferring motion to the movable limbs. Accordingly, in the embodiment of FIG. 5, an air compressor 30 is used to pressurize a gas reservoir 31, wherein adequate gas pressure is maintained to repeatedly operate the system. The outlet of the reservoir is controlled by an electrically-activatable fluid control valve 32, such as a solenoid valve, plumbed between the reservoir and the tubing, and the trigger device 11 is an electrical signalling device electrically connected to the fluid control valve.

In this embodiment, when the trigger device is actuated, an electrical signal is sent to the fluid control valve, which then opens to allow gas under pressure in the reservoir to flow into the fluid-actuating system, thus moving the movable arm(s).

The fluid control valve may be an on/off type of valve, or even a three-way valve, plumbed such that electrical actuation results in communication of the pressure reservoir with the fluid-actuating system and pressurization of the tubing, and electrical deactivation results in communication of the fluid-actuating system with the atmosphere, so as to depressurize the system.

In this embodiment, the trigger device may be one or more simple electrical contacts, either embedded in an elastomeric mat disposed in front of the simulated human figure, or encompassed in a remote actuating system, such as a push button. In this case, a second person such as a sports coach, may remotely activate the invention. Additionally, the trigger device may be another electrical signal-generating device, such as a piezoelectric material embedded in an elastomeric mat, an electric eye system or a proximity sensor, such as an ultrasonic sensor, and may be positioned as desired, relative to the simulated figure. The trigger device and the fluid control valve may have suitable circuit means connected therebetween, to provide a suitable electrical signal to the valve.

Those skilled in the art will recognize that the movement of the limbs may be reversed in a number of suitable ways, such as manually, or by spring loading the limbs in the return direction or the like. The system may even be constructed such that the weight of the movable limbs themselves is adequate to effect reversal of movement.

Furthermore, while the illustrated embodiment of the sports training device is a basketball training device, the invention may be applied to any sport wherein the sport player must become acclimated to diversions or distractions of an opposing player, such as in hockey, soccer, etc. A more complex plumbing and activation system, which would allow movement of all limbs, such as for a hockey goalie, is well-within the skill of the artisan and is intended to be within the scope of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A sports training device, comprising:

a life-sized, simulated human figure having at least one movable limb;

a fluid-containing actuating system operatively connected to said movable limb; and trigger means connected to said fluid-containing actuating system, for activating said fluid-containing actuating system and causing said at least one movable limb to move, wherein said trigger means is selectively actuatable by a foot of a user of said sports training device, said trigger means being in the form of a substantially flat, flexible, foot mat located at substantially a ground level on a front side of said life-sized, simulated human figure, and said substantially flat, flexible foot mat being capable of withstanding an entire weight of the user during normal operation of said sports training device.

2. The sports training device according to claim 1, wherein said fluid-containing actuating system comprises:

a reservoir to store the fluid;

tubing having proximal and distal ends, connected to said reservoir at the proximal end and connected to said movable limb at the distal end, to contain and transmit the fluid to the movable limb; and pressure conversion means connected to the distal end of said tubing and to said movable limb, to convert fluid pressure to linear or rotational motion of said movable limb.

3. The sports training device according to claim 1, wherein the fluid in the actuating system is a liquid.

4. The sports training device according to claim 1, wherein the fluid in the actuating system is a gas.

5. The sports training device according to claim 2, wherein said substantially flat, flexible foot mat constitutes said reservoir.

6. The sports training device according to claim 5, wherein said substantially flat, flexible foot mat is constructed of an elastomeric material.

7. The sports training device according to claim 2, wherein said fluid-containing actuating system further comprises an electrically-activated fluid control valve plumbed between said reservoir and said tubing, for controlling release of fluid pressure to said pressure conversion means.

8. The sports training device according to claim 7, wherein said trigger means comprises an electrical signalling device connected to said valve.

9. The sports training device according to claim 8, wherein said electrical signalling device comprises at least one electrical contact switch and wherein said at least one electrical contact switch is housed within said substantially flat, flexible foot mat.

10. The sports training device according to claim 8, wherein said electrical signalling devices comprises a piezoelectric material and wherein said piezoelectric material is housed within said substantially flat flexible foot mat.

11. The sports training device according to claim 2, wherein said pressure conversion means comprises a bellows.

12. The sports training device according to claim 2, wherein said pressure conversion means comprises a piston.

13. The sports training device according to claim 12, wherein said pressure conversion means further comprises a rack and pinion gear system, wherein the rack gear is operatively connected to said piston.

14. The sports training device according to claim 1, comprising two movable limbs and a fluid splitter in said fluid-containing actuating system.

15. The sports training device according to claim 1, wherein said movable limb is slidably attached to said life-sized, simulated human figure.

16. The sports training device according to claim 1, wherein said movable limb is pivotally attached to said life-sized, simulated human figure.

17. A basketball training device, comprising:

(i) a life-sized, simulated human figure having at least one movable arm;

(ii) a fluid-containing actuating system comprising:

a reservoir to store the fluid;

tubing having proximal and distal ends, connected to said reservoir at the proximal end and connected to said movable arm at the distal end, to contain and transmit the fluid to the movable arm; and pressure conversion means connected to the distal end of said tubing, to convert fluid pressure to linear or rotational motion of said movable arm, and operatively connected to said movable arm; and (iii) trigger means connected to said fluid-containing actuating system, for activating said fluid-containing actuating system and causing said at least one movable arm to move, wherein said trigger means is selectively actuatable by a foot of a user of said basketball training device, said trigger means being in the form of a substantially flat, flexible foot mat located at substantially a ground level on a front side of said life-sized, simulated human figure, and said substantially flat, flexible foot mat being capable of withstanding an entire weight of the user during normal operation of said basketball training device.

* * * * *